United States Patent [19]

Pitt et al.

[11] Patent Number: 4,494,694

[45] Date of Patent: Jan. 22, 1985

[54] SUPPORT SYSTEM FOR A RAILROAD TRACK

[75] Inventors: John M. Pitt, Nevada; Richard L. Handy; Robert O. Lamb, both of Ames, all of Iowa

[73] Assignee: Iowa State University Research Foundation, Inc., Ames, Iowa

[21] Appl. No.: 425,181

[22] Filed: Sep. 28, 1982

[51] Int. Cl.[3] ..... E01B 1/00

[52] U.S. Cl. ..... 238/2; 238/119; 405/233; 405/266

[58] Field of Search ..... 238/2, 115, 119, 109; 405/230, 233, 258, 266, 269

[56] References Cited

U.S. PATENT DOCUMENTS

| | | | |
|---|---|---|---|
| 152,469 | 6/1874 | Dehuff | 238/119 X |
| 345,054 | 7/1886 | Hyman | 238/119 |
| 536,465 | 3/1895 | Gay | 238/119 |
| 1,745,744 | 2/1930 | Day | 238/2 |
| 3,504,497 | 4/1970 | Turzillo | 405/266 |
| 3,920.182 | 11/1975 | Molyneux | 238/2 X |
| 3,984,989 | 10/1976 | Turzillo | 405/233 |
| 4,199,279 | 4/1980 | Himeji et al. | 405/233 X |

FOREIGN PATENT DOCUMENTS

| | | | |
|---|---|---|---|
| 465751 | 9/1928 | Fed. Rep. of Germany | 405/230 |
| 1104546 | 4/1961 | Fed. Rep. of Germany | 238/2 |
| 60821 | 11/1863 | France | 238/119 |
| 7692 | of 1838 | United Kingdom | 238/119 |
| 624868 | 9/1978 | U.S.S.R. | 238/2 |

*Primary Examiner*—Randolph Reese
*Assistant Examiner*—David F. Hubbuch
*Attorney, Agent, or Firm*—Zarley, McKee, Thomte, Voorhees & Sease

[57] ABSTRACT

A support system for a railroad track is described specifically adapted for the improvement of railroad subgrade performance. A plurality of vertically disposed piles are positioned below the ties and the rails of the track so that loads imposed on the cross ties will be distributed into the subgrade by the piles. The piles are preferably comprised of cementitious material. Each of the piles is comprised of a cylindrical stem portion having a funnel-shaped head portion at the upper end thereof. In one form of the invention, the cross ties rest upon the upper end of the head portion of the piles. In another form of the invention, a ballast material is positioned between the cross ties and the upper ends of the piles.

7 Claims, 8 Drawing Figures

SUPPORT SYSTEM FOR A RAILROAD TRACK

BACKGROUND OF THE INVENTION

The nation's railway trackage system has deteriorated to a point where much of the trackage is practically unusable. Much of the track in the Midwest is supported by moisture sensitive, frost susceptible subgrades, and field observations of some sections indicate that after only two years of service, approximately ⅜ths to ½ inch vertical rail deflections occur in normal service. If the nation's railway trackage system is to be improved, rehabilitation efforts must be undertaken before the tracks deteriorate to such a condition that they must be completely rebuilt.

The philosophy guiding current rehabilitation efforts is founded on the current state of technical knowledge as well as certain economic constraints. While several schemes for railbed improvement have been proposed, the only proven technique available is reduction of subgrade stress with ballast sections designed according to methodology dating back to approximately 1920. The recommended railbed improvement is ballast-subballast depths on the order of 18 to 24 inches, depending upon tie spacing. A fourfold increase in ballast cost in regions of aggregate scarcity is in itself a sizable obstacle to such reconstruction.

Yet another constraint on reconstruction is that hundreds or thousands of miles of railway embankments constructed 50 to 100 years ago are too narrow to accommodate thick ballast sections.

Other methods employed to stabilize the railbeds are: (1) incorporated chemicals; (2) injection; and (3) geotextiles. In the incorporated chemicals method of subgrade stabilization, the track and ties are first removed and the embankment exposed for additive incorporation through conventional highway construction techniques. In the injection method, Portland cement grout, lime, or lime-fly ash slurry is injected into the subgrade soils. The most recently developed method for stabilizing poor railroad subgrades is the use of geotextiles, usually a polyester or polypropylene fabric, placed between the ballast and subgrade. The prior art methods of subgrade stabilization are either functionally inadequate or economically unfeasible.

Therefore, it is a principal object of the invention to provide an improved support system for a railroad track.

A further object of the invention is to provide an improved method of subgrade soil stabilization.

A further object of the invention is to provide a support system for a railroad track comprising a plurality of vertically disposed arch-piles positioned below the cross ties.

A further object of the invention is to provide a support system for a railroad track wherein loads imposed on the cross ties will be distributed into the subgrade by a plurality of piles positioned below the ties and rails.

A further object of the invention is to provide a support system for a railroad track which is economical.

These and other objects will be apparent to those skilled in the art.

SUMMARY OF THE INVENTION

Existing railroad subgrades are stabilized by drilling a plurality of vertically disposed holes in the subgrade in such a manner so that a cylindrical stem portion is created having a funnel-shaped head portion at the upper end thereof. Preferably, the head portions of adjacent pile members are interconnected and are filled with a cementitious material to create a plurality of piles or pile members. In one form of the invention, the ties rest directly upon the upper ends of the pile members. In an another embodiment of the invention, ballast material is positioned between the upper ends of the pile members and the ties. Load imposed on the cross ties will be distributed into the subgrade by the piles.

DESCRIPTION OF THE PREFERRED EMBODIMENT

Figure 1:
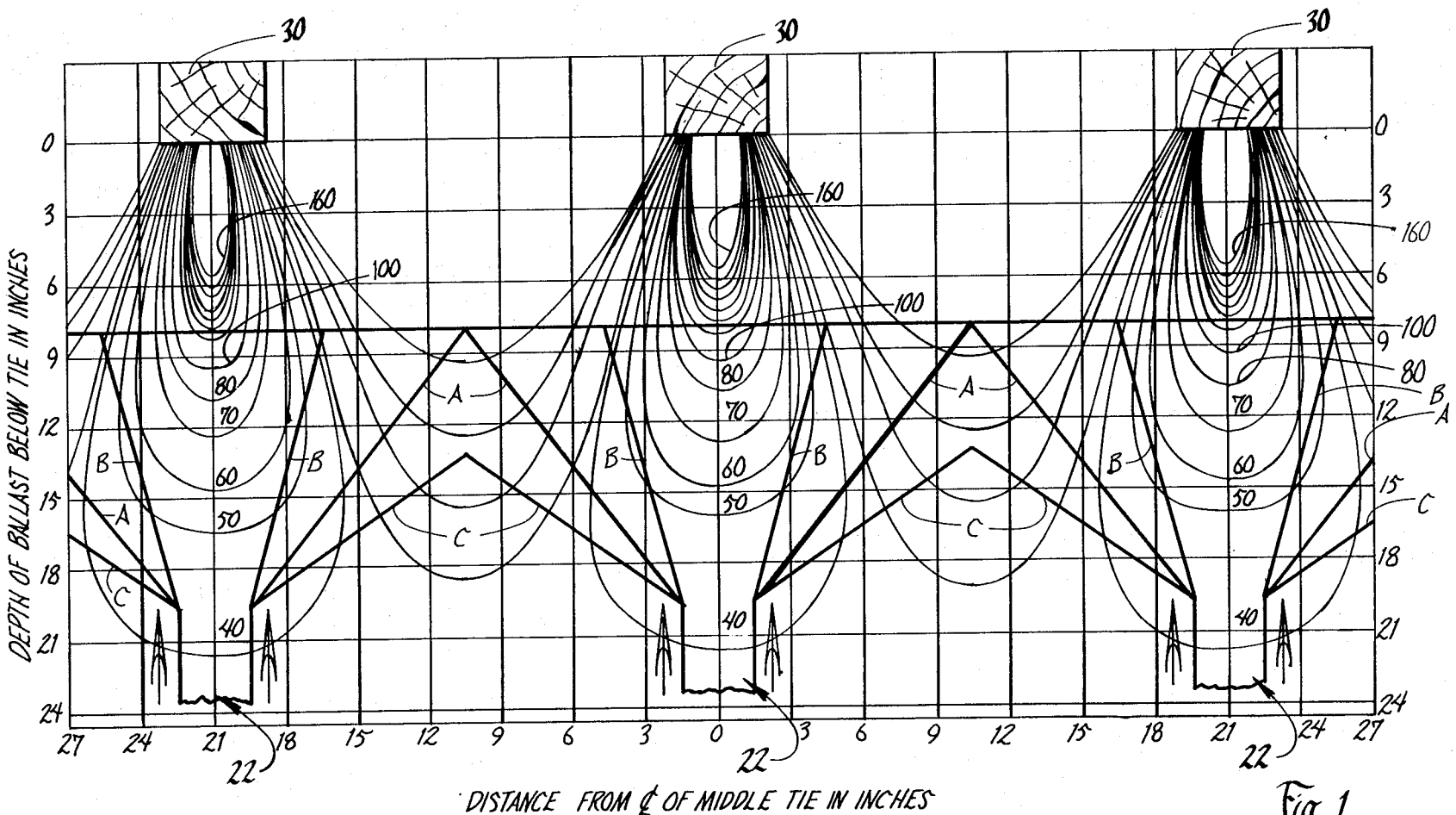
FIG. 1 illustrates the relationship between the stress distribution and the pile members of this invention.

In FIG. 1, a diagrammatic representation is depicted of the relationship of stress distribution and the piles of this invention. The stress distribution data was adapted from William W. Hay, *Railroad Engineering,* John Wiley & Sons, Inc., New York, 1953. In FIG. 1, the numbers on the contours represent percentages of average tie stress.

Figure 2:
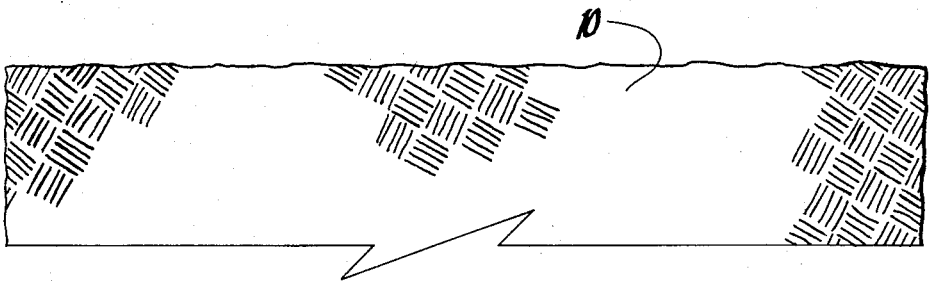
FIG. 2 is a partial sectional view illustrating the existing grade or subsurface of the roadbed.
Figure 3:
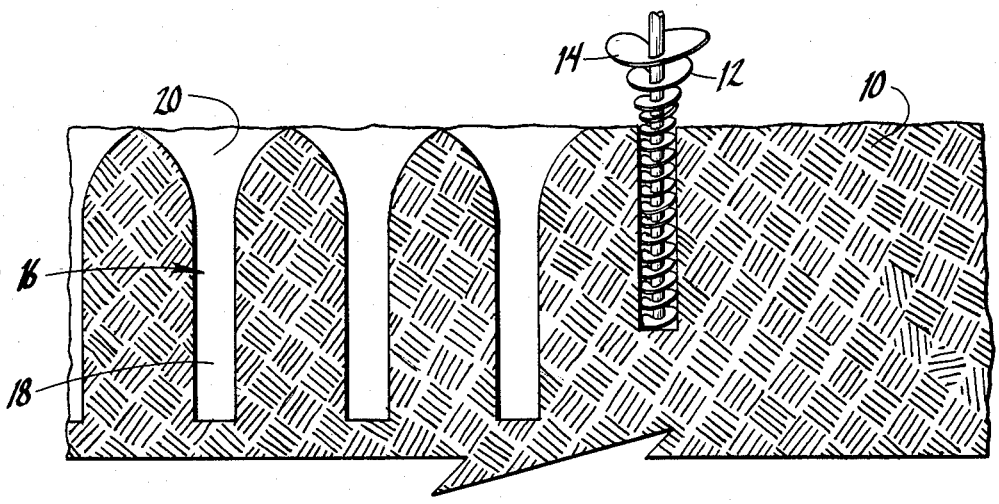
FIG. 3 is a view similar to FIG. 1 but which illustrates holes being drilled in the subgrade.
Figure 4:
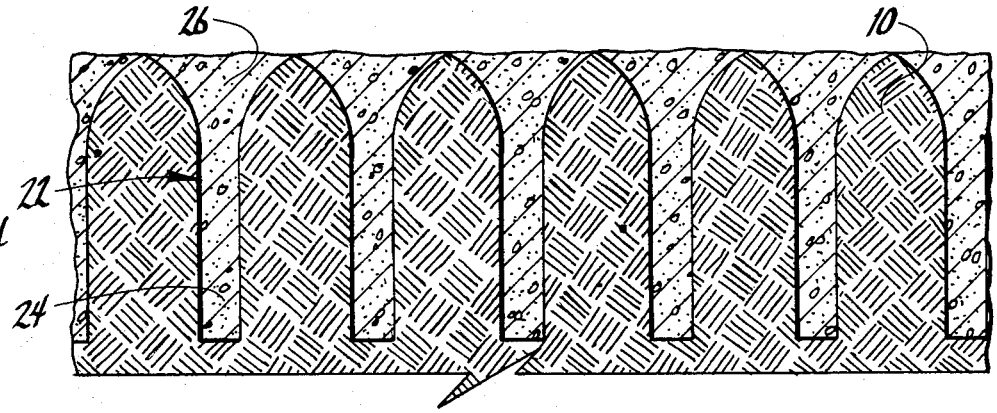
FIG. 4 is a view similar to FIG. 3 except that the holes have been filled with a cementitious material to create the support system of this invention.
Figure 5:
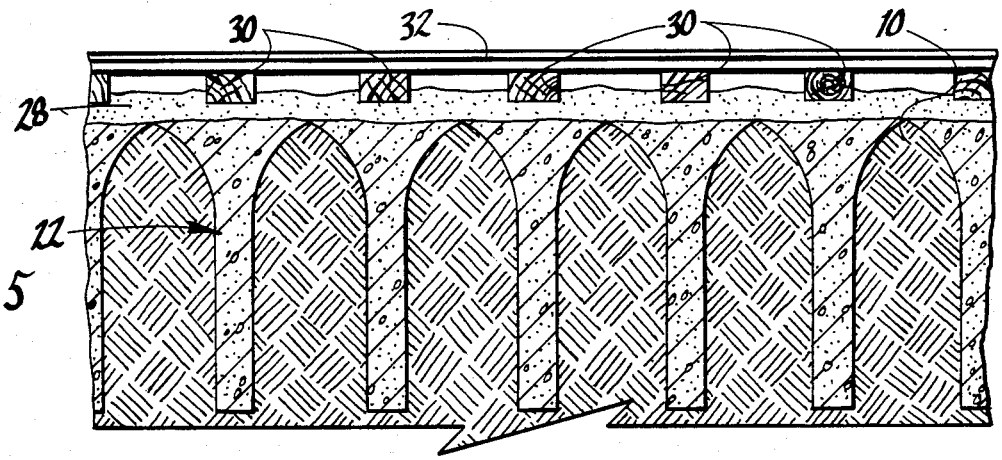
FIG. 5 is a view similar to FIG. 4 but which additionally illustrates the ballast, tracks and rails.

FIG. 2 illustrates a conventional subgrade or railroad bed generally referred to by the reference numeral 10. The cross ties and tracks are not illustrated in FIG. 2 for purposes of clarity. The support system of this invention is created in the roadbed 10 by employing an auger 12 having an enlarged portion 14 at its upper end. The auger 12 is operated to drill holes 16 along the length of the roadbed. The auger 12 forms holes having a cylindrical lower end portion 18 and a funnel-shaped upper end portion 20. The length of the hole 16 will depend upon the particular roadbed and conditions expected to be imposed on the roadbed. The holes 16 are drilled in the roadbed so as to be located beneath the rails after the ties and rails have been placed thereon.

After the holes 16 have been drilled, they are filled with a plastic cementitious material such as fly ash or Portland cement. The preferable fly ash is one that contains calcium, comprising between 7% and 10% tricalcium-aluminate, one of the components of Portland cement. If this type fly ash is used, a retarding agent should be used. Examples of retarding agents are calcium hydroxide, aluminum or aluminum sulfate. Preliminary laboratory tests indicate that 3,000 psi compressive strengths in Young's moduli near that of concrete can be realized in three day's curing of a 50% sand-fly-ash mixture.

For purposess of description, the resulting piles 22 have a cylindrical stem portion 24 and a funnel-shaped head portion 26. Preferably, the holes 16 are drilled so that the upper ends of adjacent piles interconnect. After the piles 22 have cured sufficiently, ballast 28 may be positioned thereon with the ties 30 and rail 32 then being positioned thereon so that the ties 30 are directly above the upper ends of the piles 22 and so that the rail 32 is also above the upper ends of the piles 22.

Figure 6:
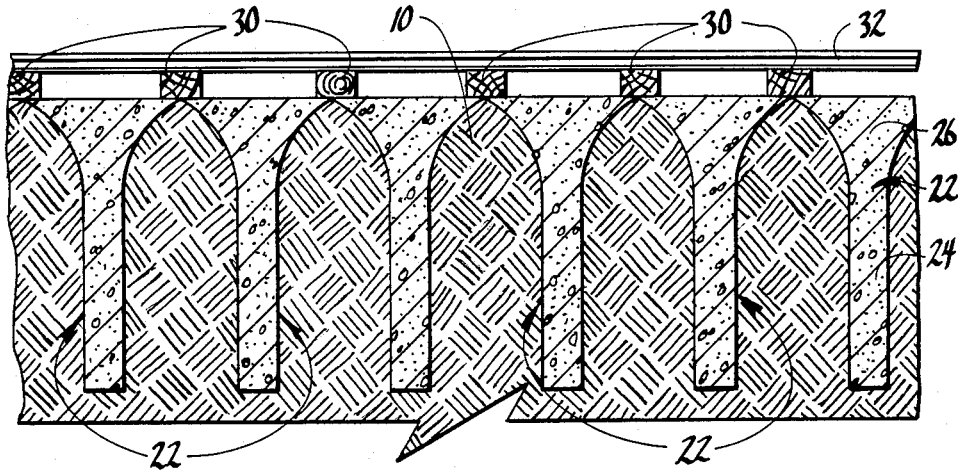
FIG. 6 is a partial sectional view illustrating a modified form of the support system.
Figure 7:
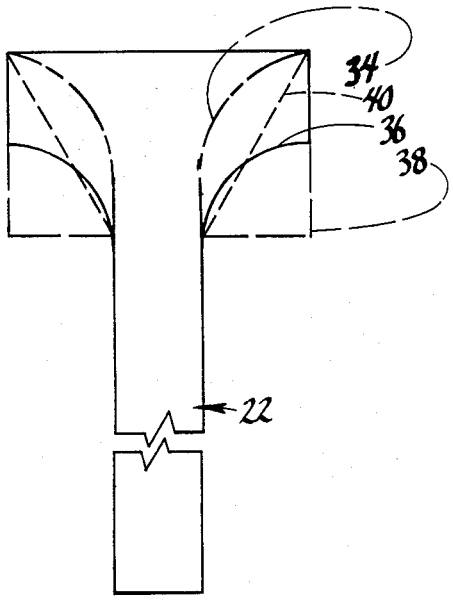
FIG. 7 is a sectional view illustrating possible configurations of the pile member.

In some situations, the ballast 28 may be eliminated and such a situation is illustrated in FIG. 6. In FIG. 6, the ties 30 are positioned directly upon the upper ends of the piles 22. FIG. 7 illustrates four possible configurations of the head portions of the piles 22. The numeral 34 refers to a catenary or parabolic arch while the numeral 36 refers to a head portion having a circular arc. The numeral 38 refers to a head portion having a prismatic configuration. Numeral 40 refers to the truncated cone or funnel-shaped configuration illustrated and referred to by the reference numeral 40.

The head shape and dimensions, and stem dimensions for the pile are determined on the basis of pile material properties, rail stiffness, ballast depth, and subgrade properties. A theoretically preferred head shape is described by a catenary or the equation $$y=(H/q_o)(Cosh(q_oX/H)-1)$$

where x and y represent relative horizontal and vertical dimensions, H is the compressive strength of the pile material, and $q_o$ is the load the arch must sustain. The catenary shape is required in a theoretical sense in that it represents a geometric form in which shear and tensile stresses are zero. However, many practical alternatives can also be used. Some parabolic arches closely approximate the cantenary arch, and although they represent less efficient use of materials, truncated cones, circular arches, and prismatic sections may be used such as illustrated in FIG. 7. The length and diameter of the stem section is dependent on the ultimate strength and deformation properties of the subgrade soil, deformation characteristics of the pile material, and the amount of composite structural track deflection for the desired level of performance. Stem dimensions can be determined through computations based on theoretical soil mechanics.

Figure 8:
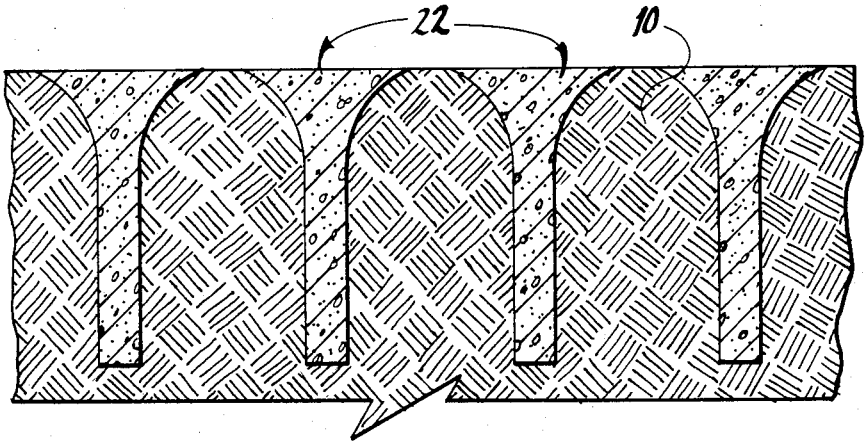
FIG. 8 is a view similar to FIG. 4 except that the heads of the piles are illustrated in a separated condition.

FIG. 8 illustrates a form of the invention wherein the piles 22 are not interconnected but are separated.

As illustrated in FIG. 1, several head configurations are possible. A funnel extending midway between the ties (reference A) insures that most of the load imposed on the subgrade would be directed to the stem while configuration B allows the pile to accept less load and the surrounding subgrade more. An interconnection between piles (reference C) would insure continuity, thus providing more rigid composite reinforcement for less stem length. For thinner ballast depths, the pile elevation can be raised and it should be possible to decrease head dimensions with the pile accomodating all the tie induced stress. A theoretical possibility would be placing the pile in contact with the base of a tie thus producing stress at the subgrade interface and within the ballast itself. As is commonly known in the railroad industry, traffic action often shifts ties from their original position. Thus a second function of the funnel caps is to accomodate minor changes in tie position.

Thus it can be seen that a novel approach has been described for reinforcing subgrade soil by the rational placement of reinforcing elements or piles in direct opposition to imposed loads. Referring to FIG. 1, the stresses occurring on the subgrade directly beneath the ties represent the problem zones and the funnel-shaped piles of this invention, when placed in rows beneath the rails, causes a portion of the high intensity subgrade stresses to be intercepted by the more competent pile material and distributed from the head to the stem thereof. The stem length of the pile can be adjusted to carry the described amount of load and impose the necessary degree of foundation stiffness and support capacity.

Although the placement of the pile previously described is the preferred technique, the placement may be achieved through one of several techniques. For cohesive soils where the hole stands open, the stem and head cavity can be created by drilling with a specially shaped auger, driving or vibrating a specially shaped mandrel, or by a combination mandrel-auger action where the stem is driven and the cap is filled or vice-versa. The pile material is next introduced as a plastic, flowable material after removal of the drilling instrument of by a flow through a hollow drill or mandrel. The pile is allowed to harden and gain strength. Placement of the pile in or through non-cohesive soil is best accomplished with a hollow mandrel. Slight amounts of pressure should be used to cause the plastic pile material to flow. However, such pressure must be limited so that subgrade strength is not reduced through creation of excess soil pore pressure.

An alternative method for placement of the pile material may be achieved without disturbing the rail-tie ballast portion of the track. Placement may be accomplished by penetrating the ballast and subgrade at points near the intersection of the rail and ties with a vibrating mandrel of the appropriate shape. The mandrel may have an opening in the center and parallel to the longitudinal axis through which plastic Portland cement grout or cementitious fly ash grout can be pumped. As the mandrel is withdrawn, the cement is pumped into the opening resulting from the penetration. The tie can then be shifted to a position so that it is located over the piles.

Thus it can be seen that the invention accomplishes at least all of its stated objectives.

We claim:

1. A support system for a railroad track including a pair of rails secured to a plurality of spaced-apart cross ties, comprising, a plurality of vertically disposed piles positioned directly below said ties and rails whereby loads imposed on the cross ties will be distributed into the subgrade by said piles, said piles being comprised of a cementitious material, a ballast material being positioned between the cross ties and the upper ends of said piles, and each of said piles having a cylindrical stem portion having a funnel-shaped head portion at the upper end thereof.

2. The system of claim 1 wherein the head portions of adjacent piles are interconnected.

3. The system of claim 1 wherein a pair of piles are positioned below each of the cross ties directly below the rails positioned thereon.

4. The system of claim 1 wherein said cementitious material comprises a sand-fly ash mixture.

5. The system of claim 1 wherein said cementitious material comprises a 50% sand and 50% fly ash mixture.

6. The system of claim 1 wherein said funnel-shaped head portion has a truncated cone shape.

7. The system of claim 1 wherein said funnel-shaped head portion has a catenary arch shape.

* * * * *